US007286038B1

(12) United States Patent
Wang et al.

(10) Patent No.: US 7,286,038 B1
(45) Date of Patent: Oct. 23, 2007

(54) OVER-CURRENT PROTECTION DEVICE

(75) Inventors: David Shau Chew Wang, Taipei (TW); Jyh Ming Yu, Kaohsiung (TW)

(73) Assignee: Polytronics Technology Corporation, Hsinchu (TW)

( * ) Notice: Subject to any disclaimer, the term of this patent is extended or adjusted under 35 U.S.C. 154(b) by 0 days.

(21) Appl. No.: 11/654,842

(22) Filed: Jan. 18, 2007

(30) Foreign Application Priority Data

Sep. 26, 2006 (TW) ..... 95135495 A

(51) Int. Cl.
*H01C 7/00* (2006.01)
*H01C 7/13* (2006.01)

(52) U.S. Cl. ..... 338/22 R; 338/328; 338/332; 252/512; 252/518

(58) Field of Classification Search ..... 338/22 R, 338/328, 332, 225 D; 252/511–513, 518–519
See application file for complete search history.

(56) References Cited

U.S. PATENT DOCUMENTS 5,793,276 A * 8/1998 Tosaka et al. ..... 338/22 R
6,452,476 B1 * 9/2002 Handa ..... 338/22 R
6,593,844 B1 * 7/2003 Iwao et al. ..... 338/22 R
6,778,062 B2 * 8/2004 Handa et al. ..... 338/22 R
2002/0093007 A1 * 7/2002 Handa et al. ..... 252/500
2004/0041683 A1 * 3/2004 Tosaka et al. ..... 338/22 R

* cited by examiner

*Primary Examiner*—K. Richard Lee
(74) *Attorney, Agent, or Firm*—Seyfarth Shaw LLP

(57) ABSTRACT

An over-current protection device comprises two metal foils and a positive temperature coefficient (PTC) material layer laminated between the two metal foils. The PTC material layer includes: (1) a polymer substrate, being 35-60% by volume of the PTC material layer and including a fluorine-containing crystalline polymer with a melting point higher than 150° C., e.g., polyvinylidine fluoride (PVDF); and (2) a conductive ceramic filler (e.g., titanium carbide) distributed in the polymer substrate. The conductive ceramic filler is 40-65% by volume of the PTC material layer, and has a volume resistivity less than 500 μΩ-cm. The volume resistivity of the PTC material layer is less than 0.1 Ω-cm, and the ratio of the hold current of the PTC material layer at 25° C. to the area of the PTC material layer is between 0.05 and 0.2 A/mm$^2$.

7 Claims, 2 Drawing Sheets

OVER-CURRENT PROTECTION DEVICE

BACKGROUND OF THE INVENTION (A) Field of the Invention

The present invention relates to an over-current protection device, and more particularly, to an over-current protection device with high hold current.

(B) Description of the Related Art

Because the resistance of conductive composite materials having a positive temperature coefficient (PTC) characteristic is very sensitive to temperature variation, it can be used as the material for current sensing devices, and has been widely applied to over-current protection devices or circuit devices. The resistance of the PTC conductive composite material remains extremely low at normal temperature, so that the circuit or cell can operate normally. However, when an over-current or an over-temperature event occurs in the circuit or cell, the resistance will instantaneously increases to a high resistance state (e.g. at least above $10^4$ ohms), which is the so-called trip. Therefore, the over-current will be eliminated so as to protect the cell or the circuit device.

Over-current protection devices applied in high temperature environments must meet the following two criteria: (1) the time-to-trip cannot be too fast, for example, it must be larger than 2 seconds under the circumstance of 30 A and 80° C.; and (2) it must be capable of being tripped at room temperature 25° C. and 12 A. Generally, the over-current protection devices are of small sizes, and the PTC device using carbon black as the conductive fillers cannot easily meet the above requirements. Experiments using nickel powder as the conductive filler have also been conducted; however, hydrofluoric acid is generated when the nickel powder is mixed with fluorine-containing polymer at high temperature, and thus nickel powder cannot be used.

For example, over-current protection devices applied to motor vehicles must have superior heat dissipation capability as the vehicle is often insolated under strong sunshine. Conventionally, the resistance of the device using carbon black as the conductive filler is high, thus the hold current $I_{hold}$ thereof is small (hold current is the largest current without trip). Consequently, the heat dissipation efficiency cannot be increased effectively.

In view of the above, it is urgent to make a breakthrough in ways to improve the heat dissipation efficiency of the over-current protection device to meet the above two characteristics, in order to meet the requirements for high temperature environment, such as automotive applications.

SUMMARY OF THE INVENTION

The present invention provides an over-current protection device, which can effectively increase the hold current, i.e., no trip occurs at the hold current, by adding a fluorine-containing crystalline polymer and a conductive ceramic filler, so as to improve the heat dissipation efficiency of the device. Accordingly, the over-current protection device with high hold current according to the present invention can be applied to high-temperature environments, such as automotive applications.

The present invention discloses an over-current protection device, which comprises two metal foils and a PTC material layer laminated between the two metal foils. The PTC material layer comprises: (1) a polymer substrate which is 35-60% by volume of the PTC material layer and includes a fluorine-containing crystalline polymer with a melting point higher than 150° C., e.g., polyvinylidine fluoride (PVDF) with a melting point of about 165° C.; and (2) a conductive ceramic filler, e.g., titanium carbide (TiC), which is distributed in the polymer substrate. The conductive ceramic filler is 40-65% by volume of the PTC material layer, and has a volume resistivity less than 500 μΩ-cm. The volume resistivity of the PTC material layer is less than 0.1 Ω-cm, and the ratio of the hold current of the PTC material layer at 25° C. to the area of the PTC material layer is between 0.05 and 0.2 A/mm$^2$.

Because the resistance of the conductive ceramic filler is much less than that of the carbon black, the conductive ceramic filler can effectively provide a higher hold current in the device. In addition, the fluorine-containing crystalline polymer has a higher melting point in comparison with polyethylene (PE); thus devices containing fluorine-containing crystalline polymer can still maintain a sufficient hold current in a high-temperature environment, e.g., 80° C. in a motor vehicle, so as to have the feature of rapid heat dissipation.

In order to make other objects and achievements of the present invention comprehensible and have a complete understanding of the present invention, further description accompanied with figures is provided in detail below.

DETAILED DESCRIPTION OF THE INVENTION

The characteristics of the conductive polymer of the present invention and the over-current protection device composed of the same are exemplified by taking the addition of PVDF of different proportions as follows.

Table 1 shows the ingredients by volume percentage of each experimental group (Ex. 1 to Ex. 6) and each comparison group (Comp. 1 and Comp. 2). The carbon black serving as conductive filler uses the RAVEN 430 ULTRA produced by Columbian Chemical Company, and the TiC ceramic powder serving as conductive filler uses the TI-302 produced by Micron Metals, Inc. The high density polyethylene (HDPE) of polyolefines polymer substrate uses the TAISOX HDPE-8010 produced by Formosa Plastics, Inc., and PVDF uses the KYNAR741 and KYNAR761 of ATOFINA Chemical Company.

TABLE 1

| | Titanium Carbide (TiC) | Carbon Black R430U | PVDF 741 | PVDF 761 | HDPE |
|---|---|---|---|---|---|
| Ex. 1 | 59.00% | — | 41.00% | — | — |
| Ex. 2 | 52.00% | — | 48.00% | — | — |
| Ex. 3 | 52.00% | — | 38.40% | — | 9.60% |
| Ex. 4 | 55.00% | — | 42.75% | — | 2.25% |
| Ex. 5 | 52.00% | — | — | 48.00% | — |

TABLE 1-continued

| | Titanium Carbide (TiC) | Carbon Black R430U | PVDF 741 | PVDF 761 | HDPE |
|---|---|---|---|---|---|
| Ex. 6 | 50.00% | | 50.00 | | |
| Comp. 1 | — | 50.00% | 50.00% | — | — |
| Comp. 2 | 52.00% | — | — | — | 48.00% |

Each of the experimental groups and the comparison groups is added into a HAAKE twin screw blender with the volume percentages as shown above for blending. The blending temperature is 215° C., the time for pre-mixing is 3 minutes, and the blending time is 15 minutes.

Figure 1:
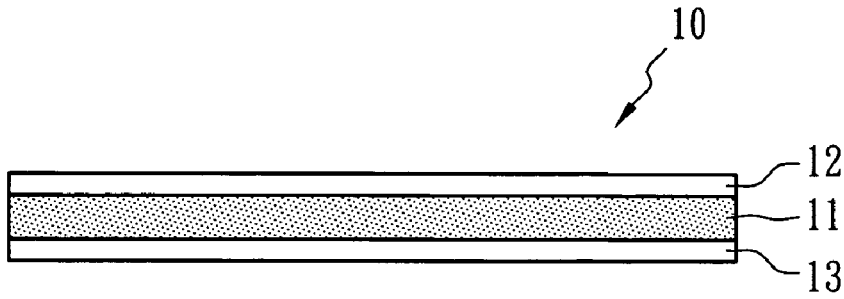
FIG. 1 is a schematic diagram of an over-current protection device according to a first embodiment of the present invention.
Figure 2:
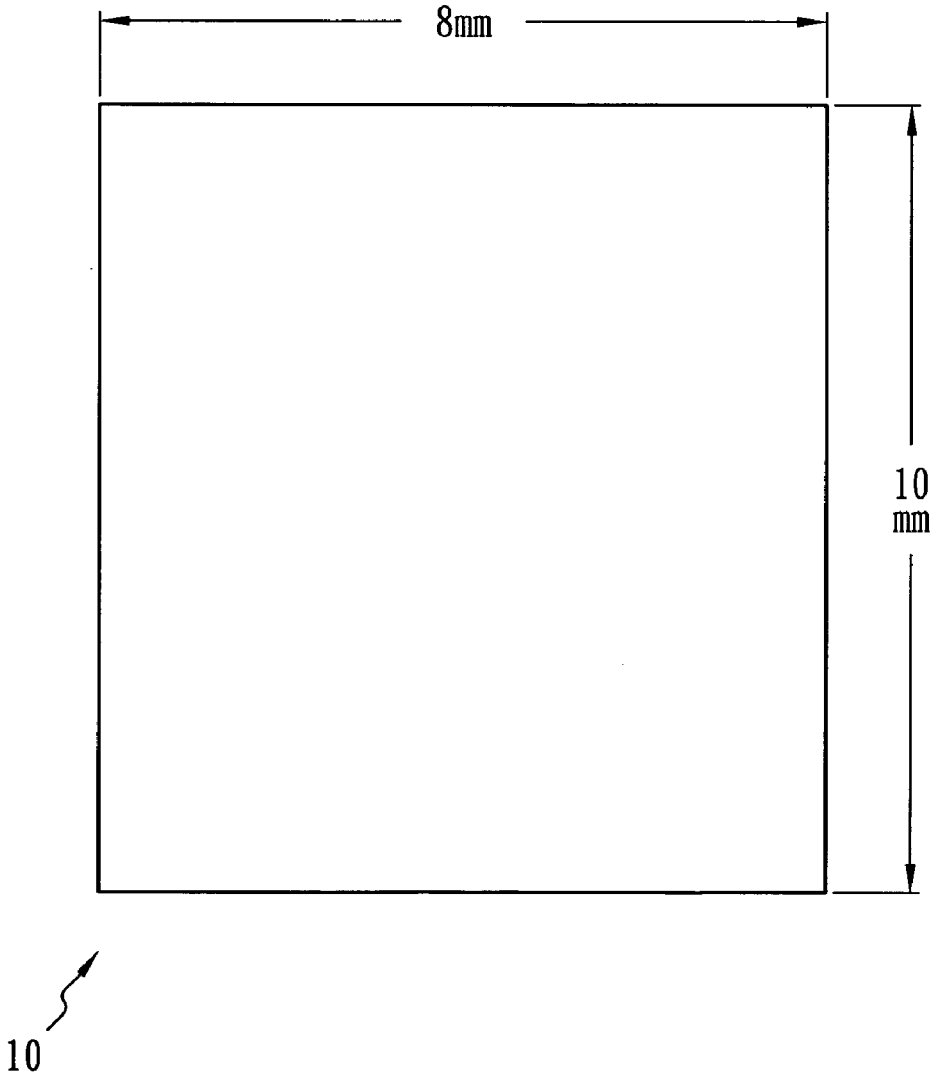
FIG. 2 is a top view of the over-current protection device of FIG. 1.

The conductive polymer after being blended is pressed into a sheet with a thickness of about 1.0-2.1 millimeters (mm) by a hot press machine at a temperature of 210° C. and a pressure of 150 kg/cm$^2$. The sheet is then cut into pieces of about 20 cm×20 cm, and two nickel-plated copper foils are laminated to two sides of the sheet with the hot press machine at a temperature of 210° C. and a pressure of 150 kg/cm$^2$. Then, the sheet with the nickel-plated copper foils is punched into PTC chips 10 as shown in FIG. 1, which is the over-current protection device of the present invention. The PTC chip 10 comprises a positive temperature coefficient (PTC) material layer 11 formed by the conductive polymer, and a first electrode layer 12 and a second electrode layer 13 formed by the nickel-plated copper foils. FIG. 2 is a top view of the PTC chip 10 in FIG. 1, and the area of the PTC chip 10 is 8 mm×10 mm, i.e., 80 mm$^2$.

Figure 3:
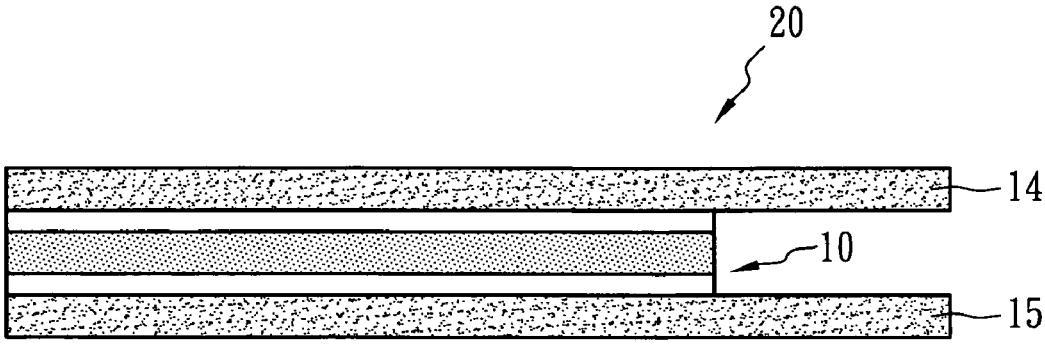
FIG. 3 is a schematic diagram of an over-current protection device according to a second embodiment of the present invention.

Referring to FIG. 3, lead-free solder paste is daubed on the outer surfaces of the first and second electrode layers 12 and 13, and two copper electrodes 14 and 15 with a thickness of 0.5 mm are respectively disposed on the tin paste on the outer surfaces of the first and second electrode layers 12 and 13, and then the assembled device is subjected to a reflow soldering process at 300° C., so as to form a PTC device 20 with a total thickness of 1.9 mm to 2.9 mm.

Figure 4:
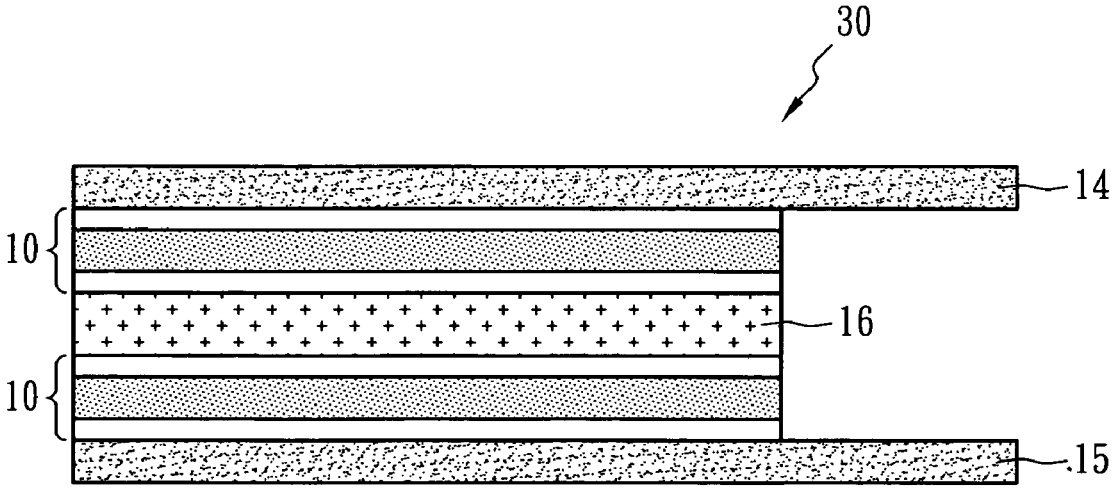
FIG. 4 is a schematic diagram of an over-current protection device according to a third embodiment of the present invention.

In another aspect, a metal heat sink 16 can be placed between two PTC chips as shown in FIG. 4. The metal heat sink could effectively dissipate heat generated from PTC and thus raise the device hold current to the level as much as 150%.

The volume percentages of the above mixed polymer substrates (PVDF or PVDF with the addition of HDPE) are all between 35% and 60%. The volume percentage of the conductive ceramic filler titanium carbide is between 40% and 65%, and preferably between 50% and 60%.

The following measurements are performed by taking five PTC devices 20 as samples for each group having different ingredients: (1) initial resistance Ri; (2) total thickness of the device; (3) time-to-trip at 80° C., 12V and 30 A; (4) hold current at 25° C. and 12V where hold current means the current below which the device will not trip; and (5) test of 10 cycles (on: 10 seconds; off: 60 seconds) at 15V and 35 A. Table 2 shows the test results of the experimental groups Ex. 1-6 and the comparison groups Comp. 1-2.

TABLE 2

| | Ri (mΩ) | Thickness (mm) | Time-to-trip @ 80 ° C./12 V/ 30 A (sec) | $I_{hold}$ @ 12 V/ 25° C. (A) | $I_{hold}$ @ 12 V/25 ° C./ area mm$^2$ (A/mm) | Cycle test @ 15 V/35 A(10 cycles) |
|---|---|---|---|---|---|---|
| Ex. 1 | 4.3 | 2.90 | 4.6 | 12.4 | 0.155 | Pass |
| Ex. 2 | 4.3 | 2.90 | 3.2 | 11.0 | 0.138 | Pass |
| Ex. 3 | 4.1 | 1.95 | 2.9 | 10.2 | 0.128 | Pass |
| Ex. 4 | 5.5 | 1.92 | 2.2 | 12.0 | 0.150 | Pass |
| Ex. 5 | 4.0 | 2.02 | 4.3 | 10.8 | 0.135 | Pass |
| Ex. 6 | 6.2 | 1.98 | 2.1 | 9.2 | 0.115 | Pass |
| Comp. 1 | 80.0 | 2.90 | 0.8 | 3.8 | 0.048 | Fail |
| Comp. 2 | 6.0 | 1.92 | 1.2 | 8.6 | 0.108 | Pass |

Table 2 shows that, as for those with addition of titanium carbide, the initial volume resistivities of the PTC material layer are much less than 0.1 Ω-cm, and the ratio of the hold current to the area of PTC material layer is preferably between 0.05 A/mm$^2$ and 0.20 A/mm$^2$, and most preferably between 0.11 A/mm$^2$ and 0.16 A/mm$^2$.

Comp. 1 uses carbon black as the conductive filler, the initial resistivity Ri is 80 mΩ, which is obviously larger than the experimental groups Ex. 1-6 and the comparison group Comp. 2 in which titanium carbide is added as the conductive ceramic filler, and the hold current ($I_{hold}$) is the lowest (<4 A). Regarding the volume resistivity, Comp. 1 exhibits high volume resistivity (>0.1 ohm-cm); however, the other examples (Ex. 1-6 and Comp. 2) show low volume resistivity (<0.1 ohm-cm). It is obvious that, in the present invention, using conductive ceramic filler such as titanium carbide can reduce the device resistance and effectively increase the hold current, thereby improving the heat dissipation efficiency of the device. Furthermore, if titanium carbide is used as the conductive ceramic filler, the volume percentage can exceed 50%, or even approach 60%, e.g., 59% in the experimental group Ex. 1, while superior effect still can be obtained.

As for the experimental groups Ex. 1-6, the time-to-trip under the test condition of 80° C., 12V, and 30 A in an automotive lock rotor is between 2.1 seconds and 4.8 seconds, which meets the requirement that the time-to-trip must be greater than 2 seconds, and the time-to-trip of the two comparison groups Comp. 1 and Comp. 2 are less than 1 second and 1.8 seconds, respectively, both of which are less than 2 seconds, and thus the two comparison groups are failed in the test.

The difference between the experimental groups (Ex. 5 and Ex. 6) and the comparison group (Comp. 2) is that the polymer in Ex. 5 and Ex. 6 is PVDF, and the polymer in Comp. 2 is HDPE. The time-to-trip values of Ex. 5 and Ex. 6 are obviously larger, indicating that using PVDF can increase the time-to-trip. Comp. 2 shows that the PTC device prepared from HDPE fails to pass the minimum 2 seconds time-to-trip test under 12V and 30 A at 80° C. In addition, the hold current generally decreases as the temperature rises, i.e., the so-called thermal derating effect. The melting point of HDPE is lower, about 130° C., and the melting point of PVDF is higher, about 165° C.; therefore the use of PVDF can slow down the decrease of the hold current, and thus a sufficient hold current can be maintained at 80° C.

In experimental groups Ex. 3 and 4, in addition to PVDF, 9.60% and 2.25% HDPE by volume are added. Although their time-to-trip values decrease slightly to 2.9 seconds and 2.2 seconds, they still fall within the required range. Therefore, the fluorine-containing polymer in the PTC material layer of the present invention can also add other polyethylene (PE), as long as the PVDF still represents a sufficient proportion and dominates the property of the mixed polymer, and thus superior effect can still be obtained.

The fluorine-containing crystalline polymer of the present invention preferably has a melting point higher than 150° C. The volume percentage of the mixed polymer substrate is preferably between 35% and 60%. The volume percentage of the conductive ceramic filler is between 40% and 65%, and the volume resistivity thereof is less than 500 μΩ-cm.

The fluorine-containing crystalline polymer is not limited to PVDF; other polymers having similar characteristics and melting points higher than 150° C. also can be used. In addition to the above materials, the fluorine-containing crystalline polymer can also be selected from the group consisting of poly(tetrafluoroethylene) (PTFE), tetrafluoroethylene-hexafluoro-propylene copolymer (FEP), ethylene-tetrafluoroethylene copolymer (PETFE), perfluoroalkoxy modified tetrafluoroethylenes (PFA), poly(chlorotri-fluorotetrafluoroethylene) (PCTFE), vinylidene fluoride-tetrafluoroethylene copolymer (VF-2-TFE), poly(vinylidene fluoride), tetrafluoroethylene-perfluorodioxole copolymers, vinylidene fluoride-hexafluoropropylene copolymer, vinylidene fluoride-hexafluoropropylene-tetrafluoroethylene terpolymer, and tetrafluoroethylene-perfluoromethylvinylether plus cure site monomer terpolymer.

The conductive ceramic filler can be selected from the group consisting of (1) metal carbides, e.g., titanium carbide (TiC), tungsten carbide (WC), vanadium carbide (VC), zirconium carbide (ZrC), niobium carbide (NbC), tantlum carbide (TaC), molybdenum carbide (MoC), hafnium carbide (HfC) in the embodiments; (2) metal borides, e.g., titanium boride ($TiB_2$), vanadium boride ($VB_2$), zirconium boride ($ZrB_2$), niobium boride ($NbB_2$), molybdenum boride ($MoB_2$), hafnium boride ($HfB_2$); and (3) metal nitrides, e.g., zirconium nitride (ZrN). They have volume resistivity less than 500 μΩ-cm.

Referring to FIG. 4, two PTC chips 10 are disposed between two electrodes 14 and 15, and a metal heat sink 16 is laminated between the two PTC chips 10. The hold current can thereby be further increased, so as to improve the heat dissipation efficiency.

FIG. 4 shows an embodiment of the present invention; the number and design of the PTC chips 10 and the metal heat sink 16 can be selected and arranged as desired.

The above-described embodiments of the present invention are intended to be illustrative only. Numerous alternative embodiments may be devised by those skilled in the art without departing from the scope of the following claims.

What is claimed is:

1. An over-current protection device, comprising:

two metal foils; and a positive temperature coefficient (PTC) material layer laminated between the two metal foils, comprising (1) a polymer substrate being 35-60% by volume of the PTC material layer and comprising a fluorine-containing crystalline polymer with a melting point higher than 150° C.; and (2) a conductive ceramic filler distributed in the polymer substrate and being 40-65% by volume of the PTC material layer and having a volume resistivity less than 500 μΩ-cm;

wherein the PTC material layer has a volume resistivity less than 0.1 Ω-cm, and the ratio of a hold current of the PTC material layer at 25° C. to the area of the PTC material layer is between 0.05 and 0.2 $A/mm^2$.

2. The over-current protection device of claim 1, wherein the fluorine-containing crystalline polymer is selected from the group consisting of polyvinylidene fluoride (PVDF) and polyethylenetetrafluoroethylene (PETFE).

3. The over-current protection device of claim 1, wherein the conductive ceramic filler is selected from the group consisting of metal carbide, metal boride and metal nitride.

4. The over-current protection device of claim 1, wherein the conductive ceramic filler is selected from the group consisting of titanium carbide, tungsten carbide, vanadium carbide, zirconium carbide, niobium carbide, tantlum carbide, molybdenum carbide, hafnium carbide, titanium boride, vanadium boride, zirconium boride, niobium boride, molybdenum boride, hafnium boride and zirconium nitride.

5. The over-current protection device of claim 1, further comprising two electrodes respectively connected to the surfaces of the two metal foils.

6. An over-current protection device, comprising:

two PTC devices, each PTC device being equivalent to the over-current protection device of claim 1;

a metal heat sink laminated between the two PTC devices; and two electrodes respectively connected to the two PTC devices.

7. The over-current protection device of claim 6, wherein the metal heat sink is connected to first surfaces of the two PTC devices, and the two electrodes are connected to second surfaces of the two PTC devices.

* * * * *